US005394314A

United States Patent [19]

Evanisko

[11] Patent Number: 5,394,314

[45] Date of Patent: Feb. 28, 1995

[54] COLD CATHODE LAMP WITH SNAP FITTED SPECULAR REFLECTOR

[75] Inventor: Jim Evanisko, Hasbrouck Heights, N.J.

[73] Assignee: National Cathode Corp., New York, N.Y.

[21] Appl. No.: 139,941

[22] Filed: Oct. 20, 1993

Related U.S. Application Data

[63] Continuation-in-part of Ser. No. 918,578, Jul. 22, 1992, abandoned.

[51] Int. Cl.[6] ..... F21V 7/14; F21V 7/16

[52] U.S. Cl. ..... 362/216; 362/255; 362/320

[58] Field of Search ..... 362/216, 217, 255, 256, 362/320, 260; 29/557; 72/379.2; 474/250

[56] References Cited

U.S. PATENT DOCUMENTS

| | | | |
|---|---|---|---|
| 1,440,980 | 1/1923 | George | 474/250 |
| 2,442,037 | 5/1948 | Carter et al. | 474/250 |
| 2,652,483 | 9/1953 | Laidig et al. | 362/216 |
| 3,661,685 | 5/1972 | Osteen | 362/431 |
| 4,412,276 | 10/1983 | Blinow | 362/320 |
| 4,562,517 | 12/1985 | Pankin | 362/217 |
| 5,079,681 | 1/1992 | Baba et al. | 362/256 |
| 5,144,539 | 9/1992 | Katoh et al. | 362/256 |

*Primary Examiner*—Richard R. Cole

*Attorney, Agent, or Firm*—Schweitzer Cornman & Gross

[57] ABSTRACT

A cold cathode fluorescent tube reflector comprises an extruded ABS thermoplastic support subtending an arc of about 317 degrees and dimensioned to snap fit to the tubular body of fluorescent glass tube. The support has bonded thereto a metallized Mylar film which comprises vapor deposited aluminum which forms a specular second surface mirror. The aluminum coating is next to the support and protected from the ambient atmosphere by the clear Mylar film. The reflector is preferably for ⅞ inch diameter tubes and has a film thickness of about 0.8 mils. In one embodiment, the metallized film is attached during extruding of the support. In the alternative, the film is secured to the support during injection molding of the support.

9 Claims, 2 Drawing Sheets

COLD CATHODE LAMP WITH SNAP FITTED SPECULAR REFLECTOR

This application is a continuation-in-part of U.S. application Ser. No. 918,578, filed Jul. 22, 1992, now abandoned.

BACKGROUND OF THE INVENTION

1. Field of the Invention

This invention relates to lighting reflectors, and more particularly, to reflectors for use with cold cathode lamps.

2. Description of the Prior Art

Cold cathode tubes have somewhat smaller diameters than conventional fluorescent tubes whose connectors are pairs of pins located each end of elongated cylindrical tube structures. In the cold cathode type tube the electrical connections comprise tubular extensions extending at right angles to the main tube body and located at each end of the light tube as shown, for example, in FIG. 1 herein. Prior art reflectors for both the typical tubes and for the cold cathode tubes usually comprise white surfaces. For example, in the larger florescent tube fixtures, the tubes are generally placed within a housing comprising a white painted cavity. This has been considered acceptable for these types of tubes.

As a carryover of these painted reflectors, the smaller cold cathode tubes also use white reflectors. The reflectors, in one implementation, comprise a snap fitted thermoplastic extruded member forming a partial enclosure about the tube along its length. These reflectors have been in use for many years. However, the earlier versions were made of styrene plastic material which during aging tended to discolor turning yellow as well as becoming brittle and fracturing easily. In more recent years, these snap fit reflectors have been made from ABS plastic. This is a white color thermoplastic material extruded into long lengths and cut to the desired lengths for a given application.

It has been discovered that because the cold cathode tubes are generally encased in the reflector structure around virtually the entire circumference (about 340 degrees), a significant amount of light may be lost due to the reflector material being used. These tubes, being smaller in diameter than the pin type tubes, are more generally limited in the amount of light radiated. Therefore, in these latter tubes, there is a need for more efficient light emission which has not heretofore been met by the prior art.

SUMMARY OF THE INVENTION

A reflector according the present invention is provided for use with a cold cathode lamp comprising a cylindrical elongated transparent glass tube having an internal fluorescent coating thereon which emits light radially through the tube along the tube length. The reflector comprises an elongated, notched, thermoplastic channel-like reflector having internal and external channel surfaces. The reflector is of C-shaped cross-section and is dimensioned for releasable snap fitting to the cold cathode tube along the tube length with the interior channel surface facing the peripheral surface of the tube such that only a portion of the peripheral surface of the tube along its length is exposed to the ambient atmosphere. A specular layer is secured to the support on the internal channel surface to provide a relatively highly reflective surface over the region of the support facing the tube. The reflector may be bent along its length to conform to shaped or otherwise bent cold cathode lamps.

IN THE DRAWING

DESCRIPTION OF THE PREFERRED EMBODIMENTS

Figures 1, 2:
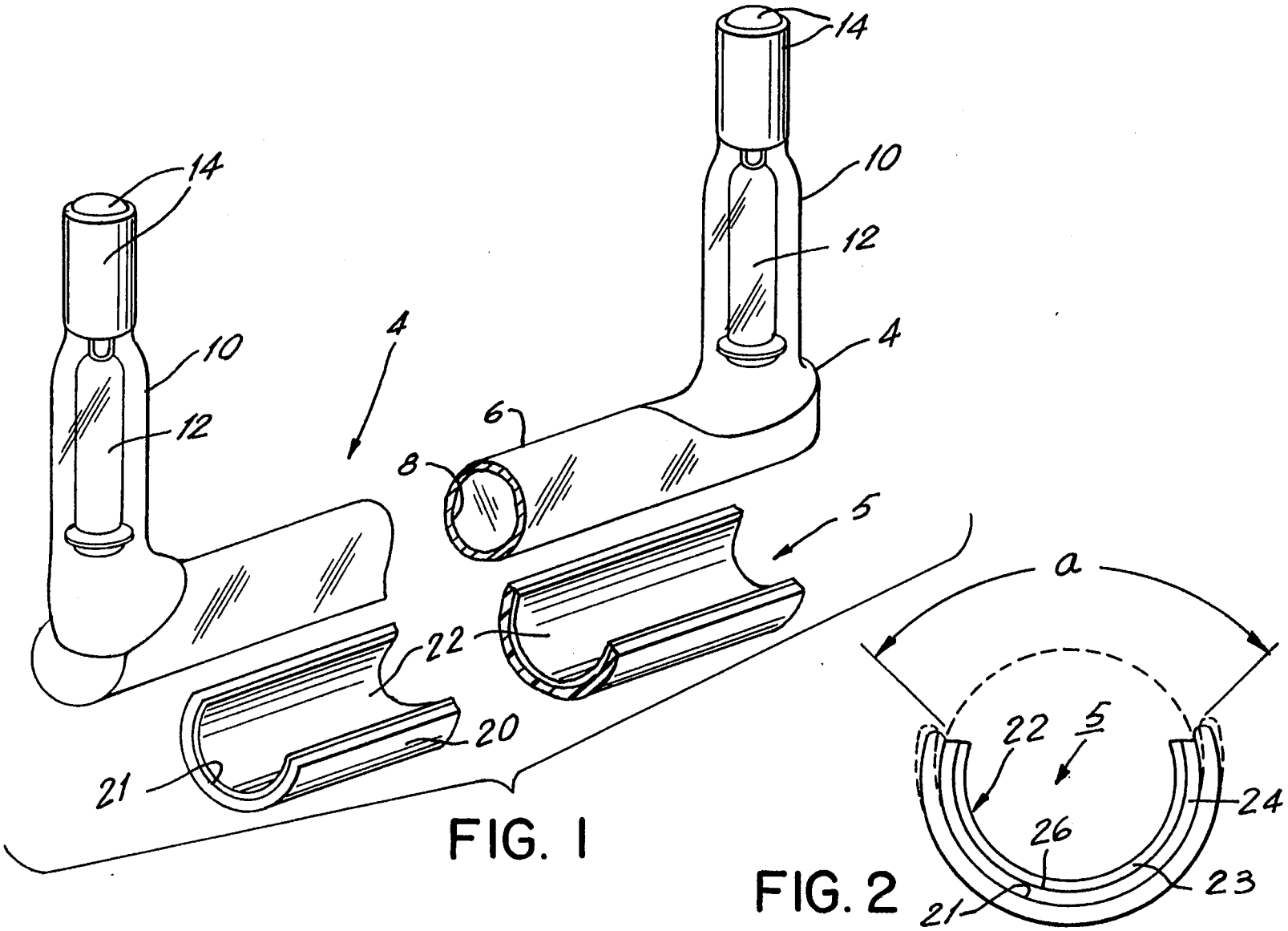
FIG. 1 is an exploded partial perspective view of a reflector and cold cathode tube according to one embodiment of the present invention.
FIG. 2 is an end view of the reflector of FIG. 1 with the fluorescent tube shown in phantom.

In FIG. 1, assembly 2 comprises a cold cathode tube 4 and a reflector 5. The tube 4 comprises an elongated tubular light emitting glass body 6 with a fluorescent coating 8 on the interior wall thereof. The electrical connections to the tube comprise two like upstanding transparent glass tubular housings 10, one at each end of the body 6. In each housing 10 is a cathode structure 12 connected to a pair of external contacts 14 for connection to a source of electrical power (not shown). As known, the coating 8 illuminates when the plasma in the body 6 is excited in a known way, emitting light which is radiated through the walls of the glass body 6. The light is emitted in an angular range of 360 degrees about the circular tubular body 6.

In FIGS. 1 and 2, reflector 5 comprises an extruded C-shaped support 20 of thermoplastic material, preferably ABS. This material is opaque and white in color as used herein. Advantageously, the support 20 has a thickness of about 0.125 inches for use with a glass body 6 of about $\frac{7}{8}$ inch in diameter providing an external diameter of about 1.125 inches. The support 20 has a channel-like partial circular section in end view as shown in FIG. 2. The open portion of the channel in FIG. 2 subtends an angle a of about 40–45 degrees to provide the snap fit action between the reflector 5 and tube 4. Angle a depends on the flexibility or stiffness of the material forming the reflector support 20 and therefore may differ from the above accordingly.

Figure 3:
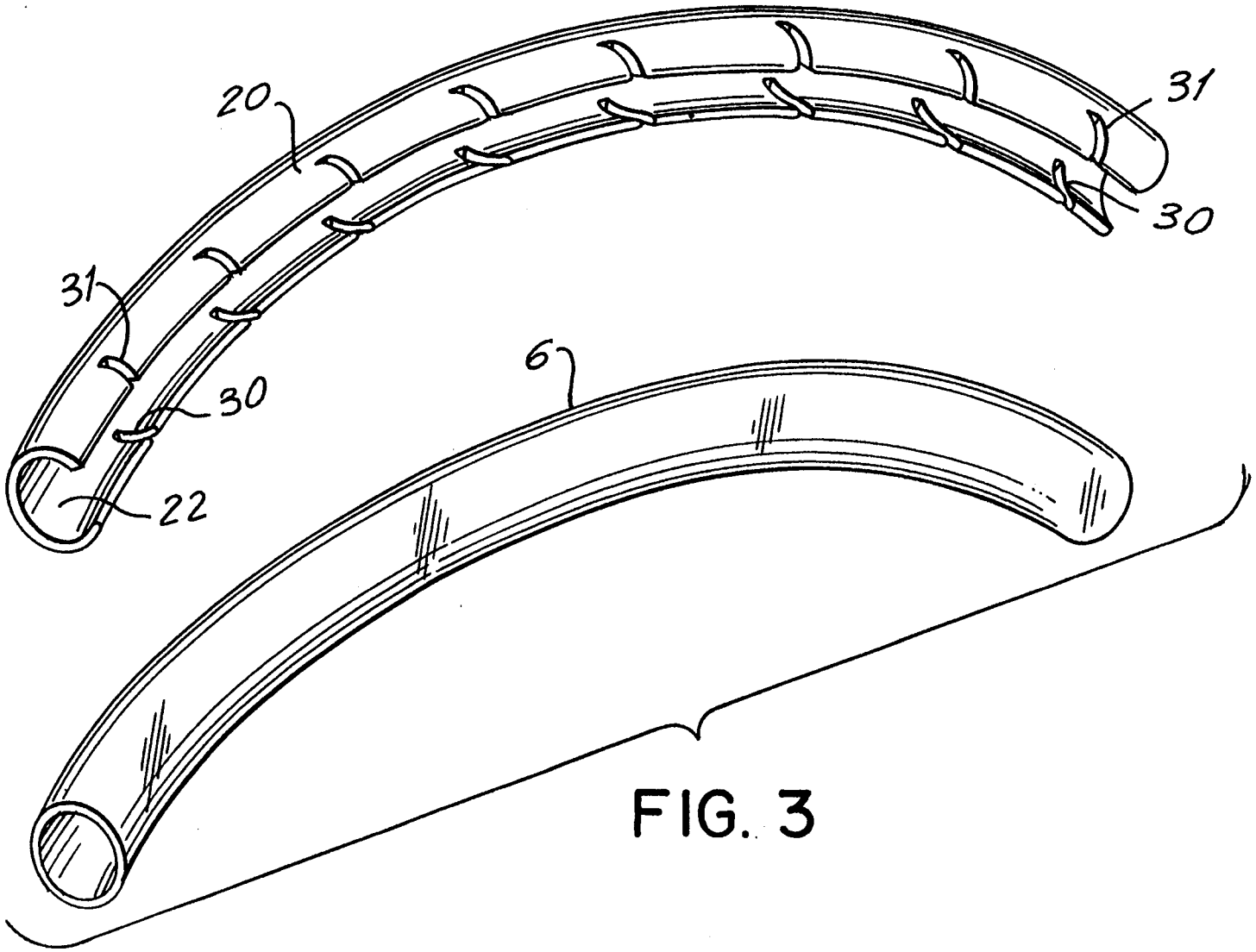
FIG. 3 is a perspective view showing a bent cold cathode tube and bent reflector in accord with the invention.

In order to conform the reflector to a curved or bent cold cathode tube, a series of parallel notches or slots 30, 31 are formed at the edges as shown in FIG. 3. The notches are approximately 0.0625 inches wide and 0.25 inches long. This arrangement permits reflectors of substantial length to be snapped on to curved sections of tubing as shown. Moreover, the new reflector may be slid along a cathode tube and rotated about the axis of such a tube in addition to being curved along its length, as will be understood.

A specular light reflecting film layer 22 is adhered to or otherwise deposited on the interior channel surface 21 of the support 20 of reflector 5. The specular layer 22 comprises a film 23 of a commercially available polyester film such as Mylar having a metallized coating 24 deposited on clear film 23 to form a specular surface 26. Film 23 preferably has a thickness of about 1/128 inches (0.8 mils), although an acceptable range is approximately 0.5–1.0 mils. A specular surface 26 is formed at the interstice of film 23 and metallized coating 24. An adhesive is used to bond the film assembly 22 to the interior channel surface of the support 20. In the alternative to assembly 22, a specular surface may be formed by vapor deposition of aluminum directly onto the surface 21 of the support 20.

The reflector 5 is formed by extruding the support 20 and during the extrusion process the film assembly 22 is thermally, autogenously bonded to the interior channel surface 21 of the support 20. In an alternative process, the support may be injection molded and the film assembly attached directly to the support during the injection molding process. When extruded, the reflector is then notched or serrated before being cut to the desired lengths corresponding to the length of the light tube to which the reflector is to be attached.

In one embodiment, the film 23 may comprise 200 Dun-Chrome, super clear DA460P comprising 200 gauge biaxially oriented polyethylene terephthalate as available from Elite Plastic Corp., Hawthorne, N.J. This film has the property of 25,000 psi MD & TD ASTM D-082A with a thickness of 0.002 inches. The specular finish comprises vacuum deposited aluminum 99.99% pure. The deposition is at 2–3 ohms per square electrical resistivity with a minimum 2.0 lbs. peel strength per inch of width. This material has an excellent adhesion to rigid PVC and ABS extrudates. The film exhibits a thermal shrinkage of 1.5% MD & TD 30 Min. at 150 degrees C. unrestrained.

While a preferred form of cold cathode reflector has been disclosed herein, it will be apparent to those skilled in the art that certain further modifications may be made without departing from the principles of the present invention, which shall be limited only to the scope of the appended claims.

I claim:

1. A reflector for use with a cold cathode lamp, said lamp including an elongated transparent glass tube having an internal fluorescent coating thereon which emits light radially through the tube along its length, said reflector comprising:

an elongated thermoplastic reflector support of C-shaped cross-section having internal and external surfaces, said reflector being notched by spaced opposed radial cuts, so as to be bendable said support being dimensioned for snap fitting in intimate contact with the tube and bending and rotating along the tube length with the internal support surface facing the peripheral surface of the tube such that only a portion of the peripheral surface of the tube along the tube length is exposed to the ambient atmosphere; and a specular layer adhered to the support on said internal surface to provide a relatively highly reflective surface over the region of said support facing said tube.

2. The reflector of claim 1 wherein said support in end view subtends an angle in the range of about 315 to 320 degrees.

3. The reflector of claim 1 wherein said specular layer comprises a thermoplastic film.

4. The reflector of claim 3 wherein the film comprises a light transparent member having specular coating thereon.

5. The reflector of claim 1 wherein the specular layer has a thickness of about 0.8 mils.

6. The reflector of claim 1 wherein the support is ABS plastic material.

7. The reflector of claim 1 wherein the specular layer is a reflective film secured to said support with adhesive.

8. The reflector of claim 1 wherein the specular layer is a reflective film secured to said support during injection molding of said support.

9. A reflector for use with a circular cylindrical elongated transparent glass tube having an internal fluorescent coating thereon which emits light radially through the tube along the tube length, said reflector comprising:

an elongated thermoplastic partial circular channel-like in section reflector support having internal and external surfaces, said reflector being notched by spaced opposed radial cuts, so as to be bendable, said support being dimensioned to resiliently releaseably and rotatably snap fit in intimate contact with the tube along the tube length with the interior surface facing the peripheral surface of the tube such that only a portion of the peripheral surface of the tube along the tube length is exposed to the ambient atmosphere;

a specular film layer secured to the support on said internal surface to provide a relatively highly reflective surface over the region of said support facing said tube, said film layer having a thickness of about 0.8 mils; and a layer of adhesive for securing the film to the support.

* * * * *